United States Patent [19]

Smith et al.

[11] Patent Number: 4,612,785

[45] Date of Patent: Sep. 23, 1986

[54] DIALS FOR CIRCULAR KNITTING MACHINES

[75] Inventors: Arthur R. Smith; Bertram Johnson, both of Leicester, United Kingdom

[73] Assignee: Bentley Engineering Company Limited, Leicester, England

[21] Appl. No.: 676,417

[22] Filed: Nov. 29, 1984

[30] Foreign Application Priority Data

Dec. 23, 1983 [GB] United Kingdom ..... 8334389

[51] Int. Cl.[4] ..... D04B 9/06; D04B 35/02

[52] U.S. Cl. ..... 66/25; 66/1 R; 66/123

[58] Field of Search ..... 66/1 R, 25, 123, 238, 66/241

[56] References Cited

U.S. PATENT DOCUMENTS

| | | | |
|---|---|---|---|
| 1,737,598 | 12/1929 | Lombardi | 66/25 X |
| 2,153,019 | 4/1939 | Holmes | 66/25 X |
| 3,646,779 | 3/1972 | Nuber et al. | 66/25 |
| 3,699,784 | 10/1972 | Berentzen | 66/123 |
| 3,712,083 | 1/1973 | Slof et al. | 66/123 |
| 4,036,036 | 7/1977 | Ashmead et al. | 66/123 |

FOREIGN PATENT DOCUMENTS

| | | | |
|---|---|---|---|
| 461016 | 2/1937 | United Kingdom | 66/25 |
| 2099463 | 12/1982 | United Kingdom | 66/25 |

*Primary Examiner*—Wm. Carter Reynolds

[57] ABSTRACT

A dial of a knitting machine has jacks (14) at least the operating part (18) of which is made of a cominutable, preferably plastics material, to ensure broken off parts are ground up so as not to damage the dial.

2 Claims, 4 Drawing Figures

DIALS FOR CIRCULAR KNITTING MACHINES

DESCRIPTION

1. Field of Invention

The invention relates to dials for circular knitting machines and particularly to the jacks used in such dials. The dial and cylinder of such circular knitting machines may revolve with respect to a cam system and yarn feed stations or, in the alternative, the dial position of and cylinder may be fixed and the cam system and yarn feed stations will rotate.

2. Background of Invention

The selection of needles carried in generally horizontally arranged dials in circular knitting machines requires the use of jacks and appropriate needle selecting devices. One such cylinder and dial type of circular knitting machine is proposed in GB Pat. No. 2,099,463. One persistent difficulty in prior art machines of the type shown in the referenced GB Patent specification has been that of broken butts. Because the dial is horizontal, butts which break off the actuator jacks for the needles do not fall away but can remain trapped in the cam tracks of the dial cam system. This in turn may lead to jamming, progressive breaking off of all butts and deformation of trick walls.

SUMMARY OF INVENTION

According to the invention there is provided a dial for use in a circular knitting machine having A a dial needle bed, radially extending tricks in the bed, jacks and needles in the tricks and actuating butts on the jacks During operation the needles are caused to project from the needle bed by imparting radial sliding movement to the jacks and needles;

B a dial cam system, the needle bed and cam system being relatively movable, alternative cam tracks defined by the cam system for the actuating butts on the needles and the jacks, patterning means for actuating jacks to cause needles to be selected for the appropriate sliding action;

the dial having the improvement consisting in that at least the operating butt area of the jacks is of comminutable material to thereby permit broken off butts to be ground up by hard dial components.

It has been found surprisingly that the above-mentioned persistent difficulty can be overcome by making the jacks from a comminutable material. Plastic materials, thermoplastic or thermosetting, are preferred. Such plastic jacks can be sufficiently strong to withstand the relatively light camming action characteristic of the actuation of jacks in cylinder and dial circular knitting machines yet disintegrate easily. When jack butts are broken off, they appear to disintegrate by comminution or grinding forces exerted by the relatively moving metal dial parts, thus disposing of the jack butts before harm can come to other machine components.

Preferably the entire jacks are made integrally of a plastic material and the jacks are rocking jacks and the dial has segregated annularly extending tracks for jack butts and needle butts respectively.

DRAWINGS

DESCRIPTION OF PREFERRED EMBODIMENT

Figure 1:
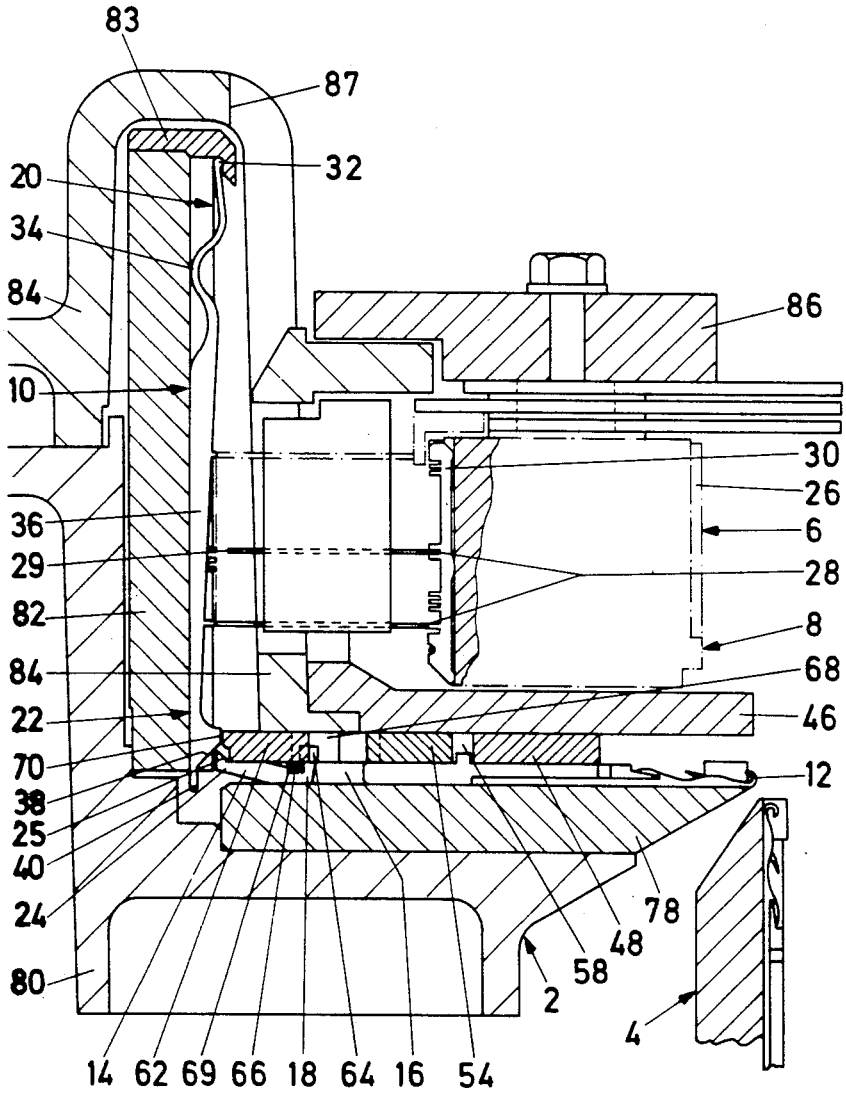
FIG. 1 is a section through a dial of a circular knitting machine of the invention along line I—I of FIG. 4.

Part of a circular knitting machine is shown in FIG. 1. The support frame, drive and yarn supply arrangements are not described in detail.

The machine has a dial indicated generally at 2 and a cylinder indicated generally at 4. In the disclosed embodiment the dial and cylinder are stationary and yarn feeders revolve together with the yarn supply (not shown) around the dial and cylinder by means of a drive (not shown). The dial 2 includes a fixed dial needle bed 78 which defines dial needle tricks 16. The dial needle bed 78 is supported on a main dial casting 80. The casting 80 supports a fixed, tricked cylindrical selector ring 82 and a revolvable main dial cam supporting casting 84 upon which are mounted a support 86 for patterning means indicated generally at 6 and a dial cam plate 46. A dial cam system indicated generally at 8 is mounted on dial cam plate 46.

The main dial cam supporting casting 84 has an opening 87 to permit selectors indicated generally at 10, to be clipped into selector ring 82 with a nose 32 restrained by an annular retainer ring 83. The selectors 10 extend downwards and lie close to jacks 14 in dial needle tricks 16 radially inwards of dial needles 12. Each jack 14 has an operating butt 18 and a jack selecting butt 24. The selector nose 32 of the associated selector 10 is at the end 20 of the selector which is remote from the dial needle tricks 16 and the jack selecting butt 24 is disposed adjacent the end 22 of a selector 10 which is closest to the tricks 16. The butt 24 has a slope 25 on one side.

Figure 4:
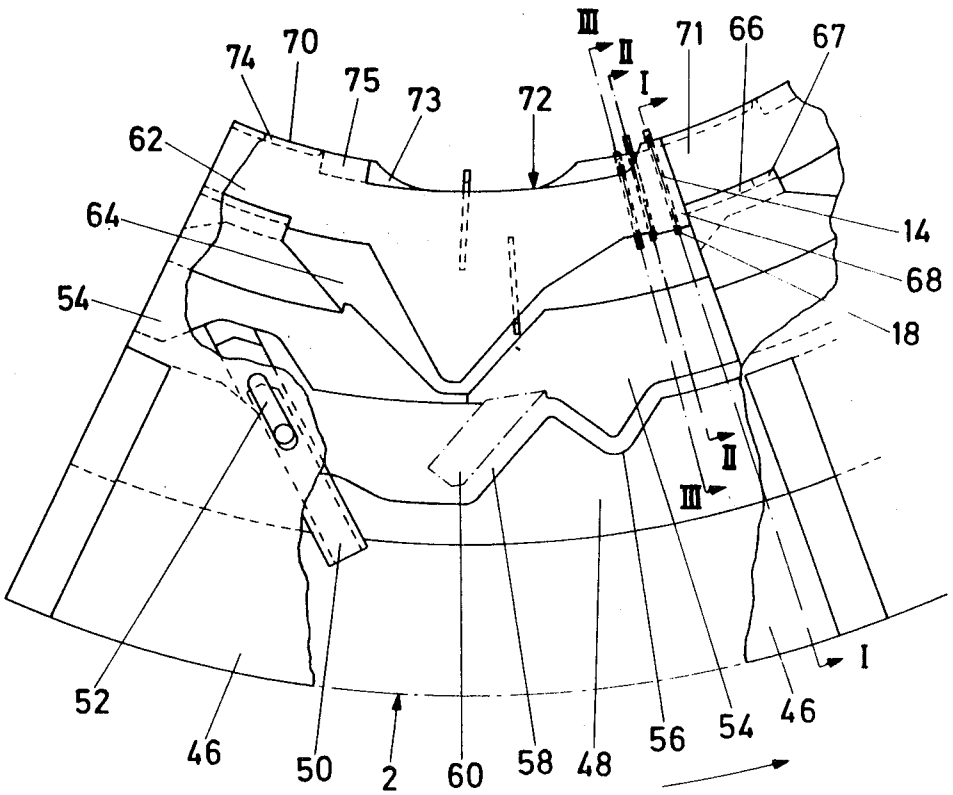
FIG. 4 is a view from above of part of the dial selecting mechanism of FIGS. 1 to 3, other parts being identical.

The patterning means 6 includes a rotatable drum 26 with pattern bits 30 for controlling thin slides 28 having a level, radially inward edge 29. It is to be noted that the slides 28 are not controlled by tension springs. The selectors each 10 have a curved part 34 just below the nose 32 but above the level occupied by a pattern butt portion 36 which can be of low height and close together for engaging the operative edges 29 of slides 28. The selectors 10 all have, at their lower ends 22, a sloped part 38 for engaging an end-most edge portion of the jack selecting butt 24. The dial cam system is shown generally in FIG. 4. A number of such systems can be used to complete an annular array. The system illustrated is for knitting selectively but the same principles can be applied for selecting for transfer.

An outer cam ring or segment 48 defines, with an intermediate cam ring 54, a track 58 for dial needle butts. The track 58 is also defined by a stitch cam 50 moveable along slot 52 for stitch adjustement. The track 58 has an initial part 56 for clearing the old loop on the dial needle 12. A bolt cam 60 can be inserted by a control system (not shown) to make all needles knit but for selective operation, jacks 14 are used.

To this end a track 64 for jack operating butts 18 is defined between the intermediate cam ring 54 and an inner cam ring 62. The track does not have a presser cam acting to push the butts 18 of the actuator jacks 14 back into the dial needle tricks 16. Instead a downwardly projecting rib 66 with a slope 67 passes through a slot 69 in the trick walls and engages the body of the jacks just clear of the butts 18. The jack track is thus uninterrupted and does not have a closed-off part through which broken butts 18 could not pass. The inner cam ring 62 is of two superposed layers with an upper layer 71 having an overhang 68 for projecting over the butts 18 for a short distance upstream of a selection position. The selecting butts 24 of the jacks 14 and the lower ends 22 of the selectors 10 are controlled by an inward facing camming edge 70 of the inner cam ring 62.

The function of the edge 70 of inner cam ring, 62 with its recess 72 at the selecting position will now be described. Generally speaking there is radially inwardly extending overhang forming projecting shoulder parts 74 for lying over the butts 24 and facing and lying against the selectors 10. The recess 72 ends with a gradually curved slope 73 at the upper layer pushing all selectors back in against spring action. At the lower layer a slope 75 causes all of the jacks to be urged downwardly at their innermost end so that even non-selected jacks are rocked once during a knitting cycle. This ensures that jacks remain freely movable for selection.

Figure 3:
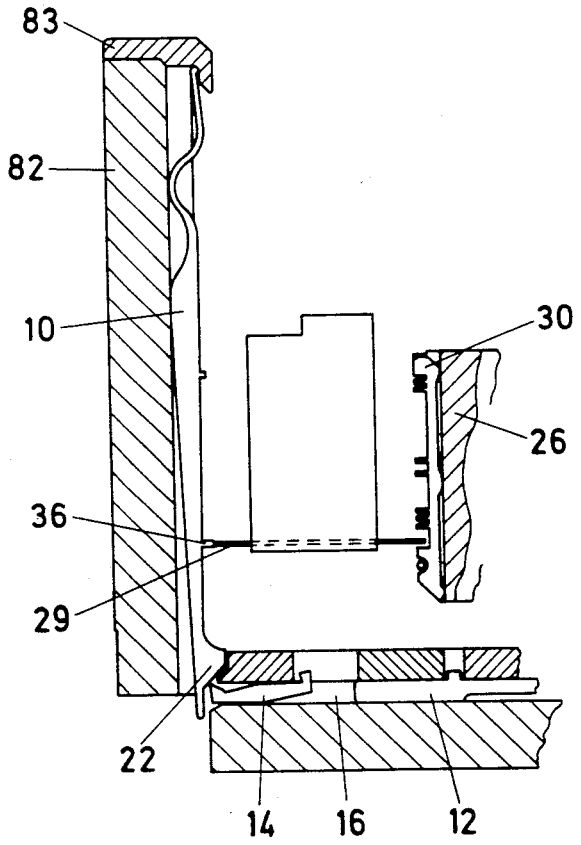
FIG. 3 is a section through the dial along line III—III of FIG. 4, the needle being selected.

In use, when a dial needle is to form a knitted stitch, the pattern bit 30 permits the slide 28 to remain retracted (see FIG. 3). The jack operating butt 18 passes under overhang 68, the jack having been rocked by the rib 66. As the recess 72 reaches the selector 10, it springs radially outward unrestrained by the slide 28. The sloped part 38 of selector 10 is pushed into the recess 72 and against the selecting butt 24 of the jack urging it radially outward and downwards. The force on slope 25 of the butt 24 pivots the rocking jack, and also pushes it outwards until the operating butt 18 clears the overhang 68 thus permitting it to project upwards. The butt 18 movement now conforms to the track 64. As the jack 14 moves radially outward its selecting butt 24 passes below the inner cam ring 62 thereby securing the rocking jack positively in position. The jack 14 pushes the needle 12 to knitting level and is returned just in advance of the radially inward motion of the dial needle 12. The dial needle 12 hence does not push the jack 14 back. The paths for jack and needle butts remain segregated. The slope 67 of the rib 66 pushes the rockers so as to move the butt 18 back in, ready for the passing of the next arriving overhang 68.

Figure 2:
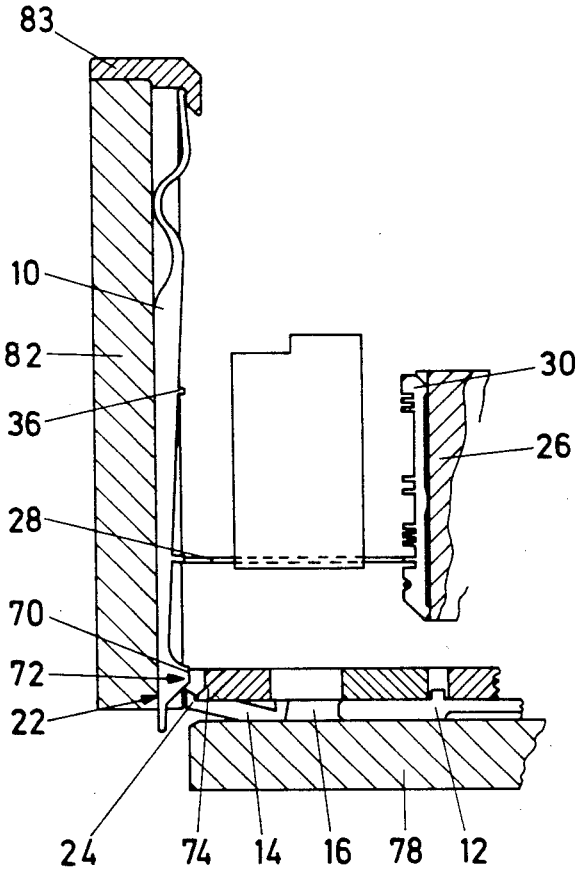
FIG. 2 is a section through the dial along line II—II of FIG. 4 with a needle not being selected.

When the dial needle is to form a float or to refrain from knitting, the pattern bit 30 projects the slide 28 (see FIG. 2). At that time the selector 10 is pushed radially inwards by the cam face 70 so the edge 29 does not have to shift the selector 10 actively against spring pressure. The overhang 68 passes over butt 18 of the jack 14 as previously but when the recess 72 arrives, the selector 10 cannot spring radially outward since it is restrained by the slide 28. Subsequently the butt operating 18 of jack 14 passes below the radially outwardly inclined part of the inner cam ring 62 holding the selecting butt 24 of the jack raised. The jack is hence kept in its inner radial position. Subsequently the selector 10 detaches from the slide 28 and moves radially outwards taking the jack 14 with it to a limited extent until further movement is prevented by cam ring 62. The jack 14 remains however un-rocked. The dial needle 12 associated with the un-rocked jack is not moved radially outward and the needle will not knit. The next arriving overhang 68 passes over the butt 18 for the repetition if required of the selection cycle. The drawings illustrate the simplicity and directness of the selection cycle and how simple and few the parts are for achieving it. No pointed cams need to be used and a large number of pattern butt levels can be arranged compactly and in a robust construction.

The rocking jacks are of a comminutable, preferably plastic material or other material which is readily disintegrated by the mechanical parts of the system in the event of butt breakage. By omitting any butt pressing cam, the jack cam track remains open for broken butts to pass over the top of the needle bed without jamming. Thus, isolated butt breakages can be dealt with by replacing the broken jack without the broken off butt having to be located and removed and without progressive butt breakage due to jamming.

The invention can be applied to suitable dial jack shapes which may be sliding jacks as opposed to rocking jacks. The invention is of particular benefit with rocking jacks. In this case the dial cam system must not only operate a butt but also hold the jack rocked and so covers a large proportion of the dial area, making jamming and crashing due to butt breakage more likely.

It is suspected that the plastic jack can be made to slide easily in the trick and that its butt becomes polished or hardened permitting it to slide smoothly over cams without exerting excessive force on the area between the butt and the body of the jack. The plastic material may for example by Nylatron (R.T.M.) made by Polypenco Limited.

In an alternative embodiment, not illustrated, the selecting mechanism may be operated electromagnetically. In that event the number of heights of pattern butts 36 can be reduced and a selecting mechanism can be chosen in which the selectors 10 are not sprung but can be rocked or even slid vertically using a camming action between electromagnetically operated devices and the selectors 10. However, the jack camming arrangement and jacks would remain unchanged.

We claim:

1. In a circular knitting machine of the type having a cylinder and a dial, the dial defining a needle bed having radially extending tricks, needles and associated actuator jacks being disposed in the tricks for radial sliding movement whereby the needles can be caused to selectively project from the needle bed, the actuator jacks and the needles having actuating butts thereon, said actuating butts projecting from the needle bed, said knitting machine further including a dial cam system, the needle bed and dial cam system being relatively movable, the cam system defining cam tracks for the jack actuating butts and the needle butts, the cam system including patterning means for actuating the jacks to cause needles to be selected for the appropriate sliding action, the improvement comprising:

the actuator jacks being at least in part fabricated from a comminutable plastic material while the remainder of the dial needle bed and dial cam system is comprised of materials which are harder than said comminutable material, said part of each of said jacks which is comprised of comminutable material including an entire actuating butt area whereby any portion of a said part of a jack butt area which becomes separated from the remainder of the jack will be ground up by contact with the harder dial components.

2. Dial as claimed in claim 1 wherein the entire jacks are made integrally of a plastic material.

* * * * *